United States Patent [19]

DeCanto et al.

[11] 4,325,556

[45] Apr. 20, 1982

[54] PLAYING DISC

[76] Inventors: Joseph F. DeCanto; Deborah L. Griffey, both of 141 Neese Dr., E-30, Nashville, Tenn. 37211

[21] Appl. No.: 167,934

[22] Filed: Jul. 14, 1980

[51] Int. Cl.[3] ..... A63F 9/02

[52] U.S. Cl. ..... 273/393; 40/27.5; 273/424

[58] Field of Search ..... 273/393, 424, 128 R; 46/74 D; 40/27.5

[56] References Cited

U.S. PATENT DOCUMENTS

| | | | |
|---|---|---|---|
| 2,212,766 | 8/1940 | Andelenis | 273/424 |
| 3,201,128 | 8/1965 | Palovik | 273/424 X |
| 3,594,945 | 7/1971 | Turney | 46/74 D UX |
| 4,196,540 | 4/1980 | Hembree et al. | 273/424 X |

FOREIGN PATENT DOCUMENTS

| | | | |
|---|---|---|---|
| 612661 | 11/1948 | United Kingdom | 273/424 |

*Primary Examiner*—Anton O. Oechsle

*Attorney, Agent, or Firm*—Harrington A. Lackey

[57] ABSTRACT

A plurality of playing discs adapted to be used in a game in which one playing disc is thrown against a stack of other playing discs, in an attempt to dislodge and upset the discs in the stack. Each playing disc is uniform and characterized by a central depressed area in the top face of each disc, and preferably, a plurality of circumferentially spaced intermediate recesses between the central depressed area and an outer rim of uniform thickness, such central depressed area and recesses creating pockets between adjacent stacked discs, so that the air in the pockets is compressed by the flexing wall portions of adjacent discs struck by a thrown playing disc, the compressed air being expanded after the impact in order to assist thrusting an upper playing disc away from the stack.

2 Claims, 5 Drawing Figures

PLAYING DISC

BACKGROUND OF THE INVENTION

This invention relates to a game, and more particularly to a playing disc of unique construction for use in playing a game.

Playing discs of various types for playing games are well known in the art, such as poker chips, tiddly wink discs, shuffleboard discs, and quoits.

Several lesser known playing discs of unique construction are disclosed in the following U.S. Pat. Nos.:

1,935,308 Baltzley Nov. 14, 1933
3,201,128 Palovik Aug. 17, 1965
3,573,869 Duckett Apr. 6, 1971
3,610,621 Henry Oct. 5, 1971

Although Baltzley, Palovik, and Henry disclose discs having depressed central areas, nevertheless these discs do not lend themselves to being arranged in a stable stack and simultaneously creating pockets of air capable of being compressed upon the distortion of an upper disc in the stack.

SUMMARY OF THE INVENTION

It is therefore an object of this invention to provide a playing disc of unique construction for use in a unique game. The playing discs are uniform in size, shape and material, being preferably formed of a homogenous thermoplastic material of slight elasticity and of non-breakable characteristics.

Each plastic playing disc is a solid circular body of generally uniform thickness having a continuously coplanar bottom face and a top face in which the annular rim portion is continuously coplanar with no other portions of the disc body projecting upward beyond the top face of the plane of the annular rim. A relatively large central depressed area is concentrically formed in the center portion of the top face of the disc body and is preferably surrounded by an annular wall of the same uniform thickness as the annular rim. Between the annular wall and the annular rim are preferably a plurality of circumferentially spaced recesses separated by generally radially extending walls. Preferably the tops of these radially extending walls are below the plane of the top face of the disc body, including the top face of the annular rim and the annular wall.

The uniform playing discs are adapted to be arranged in a vertical stack, top face up, so that the bottom walls of the discs are adapted to seat flush against the top face portions of the annular rim to provide a stable stack. The confined spaces between the central recessed area and the circumferentially spaced recesses and the bottom face of the superjacent disc form air pockets.

When another playing disc is thrown by a player so that the edge of the thrown disc engages the top face of the top disc on the stack, the impact of the thrown disc against the top disc, and preferably against the central depressed area, causes the bottom wall portion of the central depressed area to flex downward thereby compressing the air trapped between the bottom wall portions of the central depressed areas of the top two adjacent discs. After the impact of the thrown disc upon the top disc, the compressed air forces upward the top playing disc to project the top playing disc upward and over, away from the stack.

The intermediate circumferentially spaced recesses also provide miniature pockets of air which are also compressed. Some of the compressed air in each of the recesses is retained in that particular recess, while some of the compressed air spills over the separating radially extending walls to distribute the compressed air about the entire annular recessed area.

DESCRIPTION OF THE PREFERRED EMBODIMENTS

Figure 1:
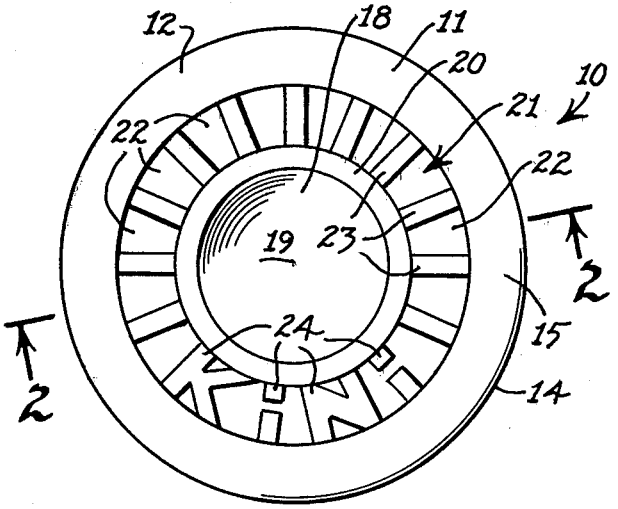
FIG. 1 is a top plan view of a playing disc made in accordance with this invention.

Referring now to the drawings in more detail, the playing disc 10 made in accordance with this invention is a unitary, preferably molded, solid disc body 11 of homogenous material, preferably thermoplastic material, having a slight elasticity, and being "non-breakable." One form of thermoplastic material from which the disc bodies 11 are made is polyethylene.

The disc body 11 is circular in shape and has substantial uniform thickness, including a generally coplanar top face 12 and a continuously coplanar bottom face 13, parallel to the plane of the top face 12. The circular edge portion 14 is preferably rounded, and in fact, semicircular in cross-section.

The body 11 includes an annular rim face 15 continuously coplanar, lying in the same plane as the general plane of the top face 12, and lying adjacent the circular edge portion 14. The rim face 15 is of sufficient radial extent that it will seat flush against the corresponding portion of the bottom face 13 of an adjacent upper disc 10 in a stack 16 (FIGS. 3, 4 and 5).

Figure 2:
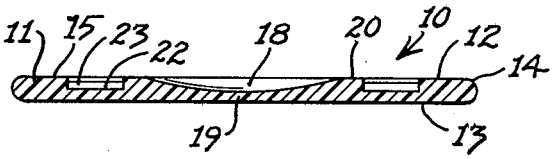
FIG. 2 is a section taken along the line 2—2 of FIG. 1.

A central depressed area 18 is formed concentrically in the middle of the top face of the disc body 11. As disclosed in the drawings, the central depressed area 18 is circular in plan view, having a diameter about ⅜th of the overall diameter of the disc body 11. More specifically, as disclosed in FIGS. 2, 4 and 5, the central depressed area 18 has a spherical concave shape forming a bottom wall portion 19 relatively thin compared with the thickness of the disc body 11, and being more flexible than the disc body 11. The edge of the central depressed area 18 defines an annular wall 20 having a top face which is preferably also coplanar with the rim face 15.

Between the annular wall 20 and the rim face 15 is an intermediate circumferential recess area 21, including a plurality of circumferentially spaced recesses 22, each pair of recesses 22 being separated by a substantially radially extending divider wall 23. As best disclosed in FIGS. 2 and 4, the radial divider walls 23 have top faces which are depressed below the plane of the top face 12, that is below the plane of the rim face 15 and the annular wall 20. Some of these divider walls 24 may be in the form of decorative symbols or letters, such as the name of the game "KiNi," illustrated in FIG. 1.

Figure 3:
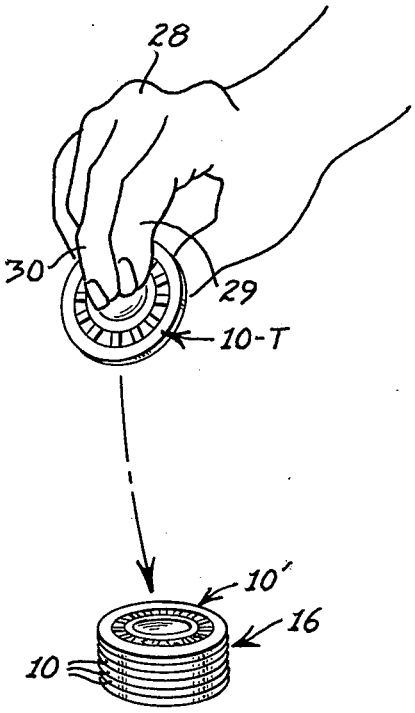
FIG. 3 is a top perspective view of a stack of playing discs and another playing disc in the hand of the player in position for being thrown down upon the stack.
Figure 4:
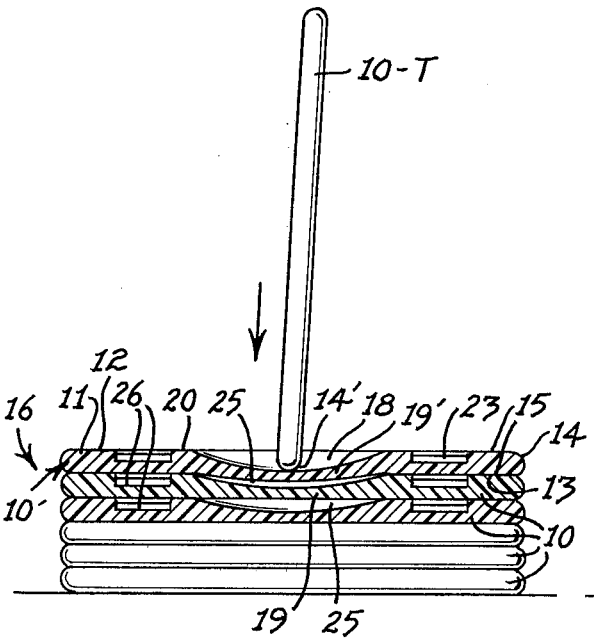
FIG. 4 is a side elevation of a stack of playing discs, the upper disc being shown in section, and the thrown disc of FIG. 3 impacting the top playing disc to flex the bottom wall portion of the central depressed area.
Figure 5:
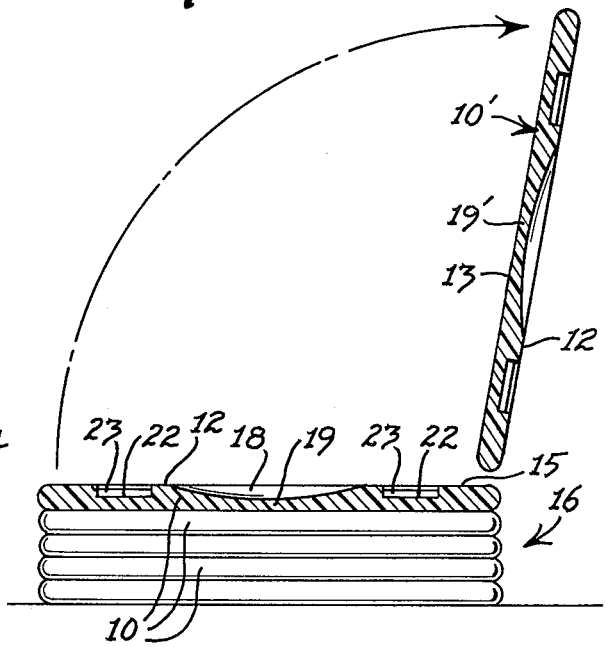
FIG. 5 is a view similar to FIG. 4, with the top playing disc in a turned position projected from the stack.

The structure of the playing disc 10 is particularly adapted to play a particular game (referred to as "KiNi") in which a plurality of the discs 10 are arranged in a vertical stack 16, such as the six stacked discs 10 and 10' disclosed in FIGS. 3 and 4. The discs 10 in the stack are all arranged face up and in vertical alignment so that all of the annular rim faces 15 seat flush against the corresponding portions of the bottom face 13 of the adjacent upper discs 10, and all the central depressed areas 18 are also vertically aligned. Moreover, the circumferential recessed areas 21 are in vertical alignment. Thus, as best illustrated in FIG. 4, air pockets are formed between the bottom wall portions 19 and 19' of the depressed areas 18 and 18' and confined air pockets are formed between the various recesses 22 and the opposed bottom face portion 13 of adjacent discs 10. These air pockets 25 and 26 are completely enclosed.

In the game "KiNi", for which the disc 10 has been particularly designed, the player grasps in one hand 28 a throwing disc 10-T, as illustrated in FIG. 3, and throws the throwing disc 10-T downward with great force, and as accurately as possible, toward the stack 10. The object of the throw is to strike the top face 12, and particularly the depressed area 18 of the top disc 10' with an edge portion 14' of the disc 10-T, as illustrated in FIG. 4.

The impact of the disc 10-T against the bottom wall 19' of the top disc 10' will force the flexible bottom wall portion 19' downward to compress the air within the pocket 25 between the bottom wall portion 19' and the next lower bottom wall portion 19. Although the compressed air may tend to spread radially outward to exhaust between the disc 10' and the next lower disc 10, nevertheless the intensity of the force of the leading edge 14 of the throwing disc 10-T against the bottom wall portion 19' will not give sufficient time for the compressed air to exhaust radially. Accordingly, as the throwing disc 10-T falls away from the stack, the impact is immediately relieved causing the compressed air within the pocket 25 to immediately expand and exert an upward force upon the top disc 10'. Since it is practically impossible for the compressed air to expand in a manner to produce a resultant upward force concentric with the disc 10', the upward thrust will, of necessity, be eccentric, causing the top disc 10' to be projected upwardly and outwardly to flip over in a manner illustrated in FIG. 5. Since an object of the game is for the player to retain all discs 10 disposed in upside down position, then the construction of the discs 10 tend to assist in the production of the desired action of the discs 10.

Of course, the force of the throwing disc 10-T against the top disc 10' will produce other resultant forces which tend to upset the stack 16. For example, the impact of the throwing disc 10-T will create a bouncing or rebound action on the upper disc 10 in the stack 16, as well as a radial sliding or slipping action, also tending to upset the stack 16. Thus, the desired results of flipping any disc into an upside down position depends upon the throwing skill of the player.

As illustrated in FIG. 3, the central depressed area 18 also provides a depressed finger grip to assist the player in holding the throwing disc 10-T for not only throwing the disc 10-T, but also for controlling the direction of throwing.

Upon impact of the throwing disc 10-T upon a top disc 10', the point of impact will usually be eccentric to the vertical axis of the stack 10. Accordingly, the pockets 26 will be compressed non-uniformly. Thus, if there is greater compression of air in one pocket 26 than another, then that particular portion of the disc will receive a greater upward thrust upon the expansion of the compressed air after the impact, also facilitating the flipping of the top disc 10', such as illustrated in FIG. 5. Moreover, in order to distribute the compressed air in the recess area 21, the divider walls 23 are of lesser heights, so that some of the compressed air in the recesses 22 will spill over and flow over to other adjacent recesses 22. However, because of the divider walls 23, albeit not of full height, the greatest compressed air will be in the area closest to the point of impact of the throwing disc 10-T. Since the compressed air will be so great because of the force of the impact and the minimal amount of air, the greater tilting effect will be obtained by the distribution of the compressed air over several adjacent recesses 22, than if confined to a single pocket 26 and single recess 22.

If the divider walls 23 did not exist, then all of the individual recesses 22 would merge into a continuous annual recess, which would permit too much flow distribution of the compressed air around the intermediate recess area 21, thereby diluting the effect of any upward thrust by the expanding compressed air. The expanding compressed air in this case would dissipate itself throughout the entire annular recessed area 21. In order to prevent dissipation of the compressed air, there should be no outlets from the pockets 25 or 26 to the outside of the stack, and particularly radially between the seated discs 10 and 10'. Thus, the rim must be continuously solid and of uniform thickness throughout its circumference.

What is claimed is:

1. A playing disc adapted to be stacked with other like discs for playing a game in which another like playing disc is thrown at the stack, comprising:

(a) a solid disc body of homogenous thermoplastic material having parallel top and bottom faces, a circular edge, and a generally uniform thickness, (b) said bottom face being continuously coplanar, (c) a central depressed area in said top face defining a bottom wall portion having a thickness less than said uniform thickness of said body, (d) said bottom wall portion being more flexible than the remaining portions of said disc body, said bottom wall portion being adapted to flex under the impact of a playing disc thrown edge-wise against said bottom wall portion, (e) said top face comprising an annular, continuously coplanar, rim, adjacent said edge, no portion of said body projecting from said top face beyond the plane of said annular rim, (f) a plurality of circumferentially spaced recesses in said top face between said central depressed area and said annular rim, (g) an annular wall of said uniform thickness separating said recesses and said central depressed area, the top of said annular wall being coplanar with said rim, whereby the top of said annular wall and said coplanar rim are adapted to seat flush against the bottom face of an adjacent upper stacked playing disc to form air pockets between the bottom face of an adjacent upper stacked playing disc and said central depressed area and said recesses.

2. The invention according to claim 1 further comprising a plurality of walls separating said recesses from each other, the tops of said walls being below the plane of said rim.

* * * * *